US009316111B2

(12) United States Patent
Eleftheriou et al.

(10) Patent No.: US 9,316,111 B2
(45) Date of Patent: Apr. 19, 2016

(54) ACTIVE TURBINE TIP CLEARANCE CONTROL SYSTEM

(75) Inventors: Andreas Eleftheriou, Woodbridge (CA); Daniel Alecu, Toronto (CA)

(73) Assignee: PRATT & WHITNEY CANADA CORP., Longueuil, Quebec (CA)

( * ) Notice: Subject to any disclaimer, the term of this patent is extended or adjusted under 35 U.S.C. 154(b) by 716 days.

(21) Appl. No.: 13/326,434

(22) Filed: Dec. 15, 2011

(65) Prior Publication Data

US 2013/0156541 A1 Jun. 20, 2013

(51) Int. Cl.

| | |
|---|---|
| ***F01D 11/20*** | (2006.01) |
| ***F01D 11/22*** | (2006.01) |
| ***F01D 11/24*** | (2006.01) |

(52) U.S. Cl.

CPC ..... *F01D 11/20* (2013.01); *F01D 11/22* (2013.01); *F01D 11/24* (2013.01)

(58) Field of Classification Search

CPC ..... F01D 11/20; F01D 11/22; F01D 11/24

USPC ..... 415/144, 145, 170.1, 173.6, 173.2, 415/174.1, 177, 178

See application file for complete search history.

(56) References Cited

U.S. PATENT DOCUMENTS

| | | | | |
|---|---|---|---|---|
| 4,379,677 | A * | 4/1983 | Hallinger et al. | 415/175 |
| 4,711,084 | A | 12/1987 | Brockett | |
| 4,849,895 | A * | 7/1989 | Kervistin | 701/100 |
| 5,116,199 | A * | 5/1992 | Ciokajlo | 415/173.2 |
| 6,412,270 | B1 | 7/2002 | Mortzheim et al. | |
| 6,550,253 | B2 | 4/2003 | Mortzheim et al. | |
| 6,640,550 | B2 | 11/2003 | Hoffmann et al. | |
| 6,701,715 | B2 | 3/2004 | Anderson et al. | |
| 7,124,590 | B2 | 10/2006 | Hoff et al. | |
| 7,143,573 | B2 | 12/2006 | Hoffmann et al. | |
| 7,162,876 | B2 | 1/2007 | Hoff et al. | |
| 7,536,864 | B2 | 5/2009 | Wolfe et al. | |
| 7,698,898 | B2 | 4/2010 | Eluripati et al. | |
| 7,823,390 | B2 | 11/2010 | Eluripati et al. | |
| 7,861,536 | B2 | 1/2011 | Alecu et al. | |
| 8,092,146 | B2 * | 1/2012 | Legare et al. | 415/1 |
| 2004/0025491 | A1 * | 2/2004 | Hoffmann et al. | 60/39.182 |
| 2005/0072162 | A1 | 4/2005 | Hoff et al. | |
| 2011/0067413 | A1 | 3/2011 | Alecu et al. | |
| 2011/0072827 | A1 * | 3/2011 | Ciofini et al. | 60/772 |

* cited by examiner

*Primary Examiner* — Richard Edgar
*Assistant Examiner* — Juan G Flores
(74) *Attorney, Agent, or Firm* — Norton Rose Fulbright Canada LLP

(57) ABSTRACT

An active tip clearance control (ATCC) system of a gas turbine engine includes an ejector to selectively drive an air flow passing through the ATCC system. A high pressure air flow as a motive flow of the ejector is controlled by a valve according to engine operation requirements.

13 Claims, 5 Drawing Sheets

ACTIVE TURBINE TIP CLEARANCE CONTROL SYSTEM

TECHNICAL FIELD

The described subject matter relates generally to a gas turbine engine and more particularly, to an active tip clearance control (ATCC) system of a gas turbine engine.

BACKGROUND OF THE ART

Conventional active tip clearance control (ATCC) systems in a turbofan gas turbine engine use the fan driven bypass air, a portion of which is directed through a diffusion duct to the high pressure turbine case manifold. This portion of bypass air is directed to flow over the high pressure turbine case through a series of impingement holes. A modulating valve may be incorporated between an air inlet and the diffusion duct. This valve adjusts the portion of bypass air flow according to the engine requirements such that the appropriate tip clearance between the turbine blades and the turbine shroud is maintained. Conventional ATCC systems rely on the pressure differential between an inlet scoop at the bypass duct and a downstream location of the bypass duct where the vent cooling air is dumped. For engines in which this pressure differential is very low, the operation and/or efficiency of the ATCC system may be at risk.

Therefore, there is a need for improvements to an ATCC system.

SUMMARY

In one aspect, there is provided an active tip clearance control (ATCC) system of a gas turbine engine comprising an ATCC manifold disposed adjacent a rotor case, the manifold configured for directing air over the rotor case, an inlet passage fluidly connecting the ATCC manifold with an air source, a vent passage in fluid communication with the manifold and the atmosphere for venting air received from the ATCC manifold to the atmosphere, a controllable valve receiving and controlling a high pressure air flow, and an ejector configured to use the controlled high pressure air flow to selectively drive said air through the ATCC manifold.

In another aspect, there is provided an aircraft turbofan gas turbine engine comprising: an annular outer case surrounding a fan assembly; an annular core case positioned within the outer case and accommodating a compressor assembly, a combustion gas generator assembly and a turbine assembly, the annular outer and core cases defining an annular bypass duct therebetween for directing a bypass air flow driven by the fan assembly to pass therethrough; and an active tip clearance control (ATCC) apparatus including an ATCC manifold mounted to a turbine case for discharging cooling air over the turbine case to cool the same, an inlet passage connecting the ATCC manifold with the bypass duct at a first location of the bypass duct, a vent passage disposed downstream of the ATCC manifold and being in fluid communication with the bypass duct at a second location of the bypass duct downstream of the first location, the ATCC apparatus further including a solenoid valve controlling a high pressure air flow and an ejector using the controlled high pressure air to selectively drive the cooling air through the ATCC manifold.

In a further aspect, there is provided a method for actuating an active tip clearance control (ATCC) system of a gas turbine engine, comprising amplifying a control signal for actuating the ATCC system in steps of: a) selectively actuating a solenoid valve using an electric signal as the control signal to control an on/off condition of a high pressure air flow; and b) using the on/off-controlled high pressure air flow to selectively actuate an ejector which drives a cooling air flow through the ATCC system, thereby selectively increasing an energy level of the cooling air flow passing through the ATCC system, resulting in an increased pressure differential over the ATCC system.

Further details of these and other aspects of above concept be apparent from the detailed description and drawings included below.

BRIEF DESCRIPTION OF THE DRAWINGS

Reference is now made to the accompanying drawings depicting aspects of the described subject matter, in which.

DETAILED DESCRIPTION

Figure 1:
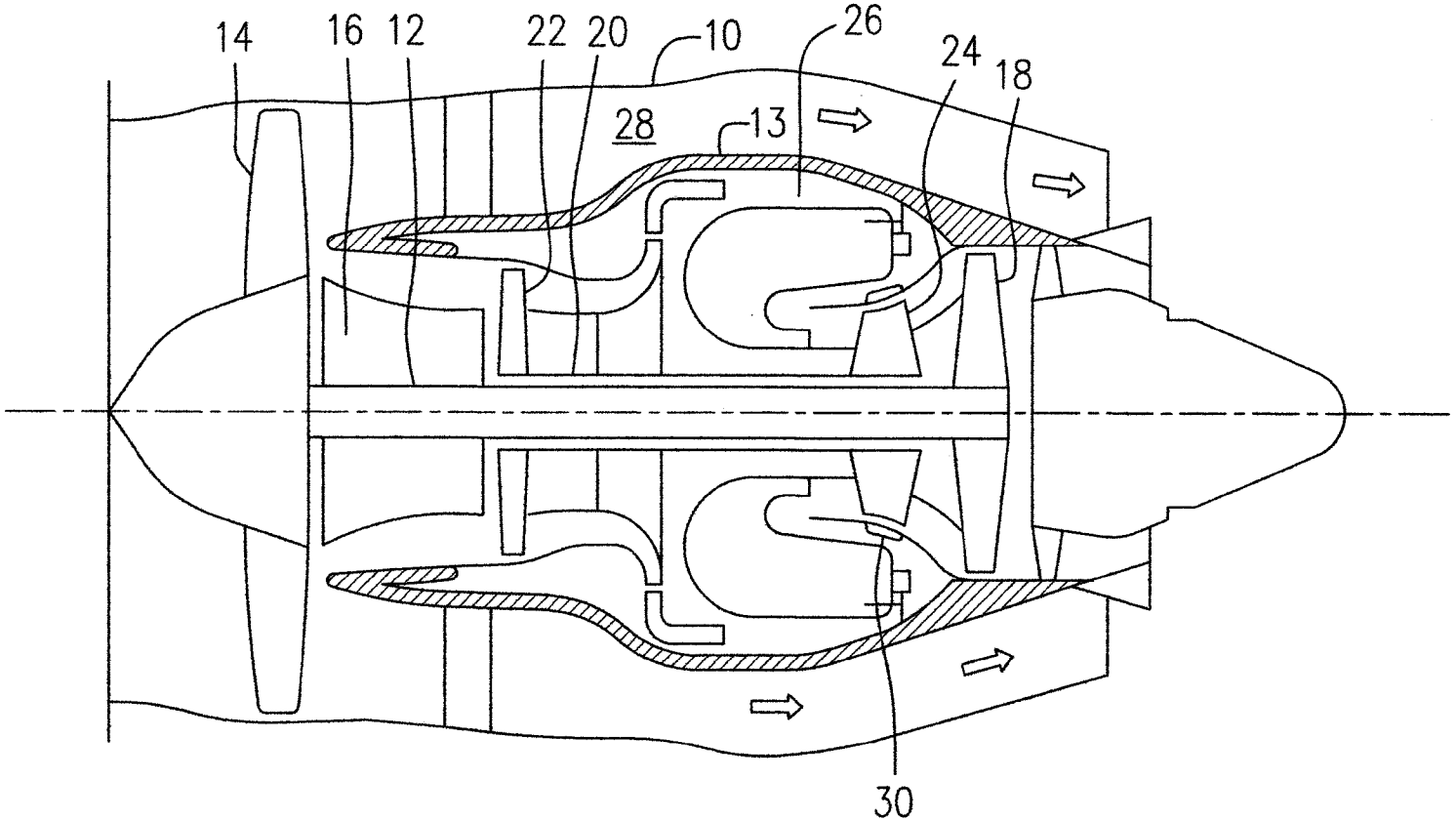
FIG. 1 is a schematic cross-sectional view of a turbofan gas turbine engine having an active tip clearance control (ATCC) system.

FIG. 1 illustrates a turbofan gas turbine aircraft engine presented as an example of the application of the described concept, including a housing or nacelle annular outer case 10, an annular core case 13, a low pressure spool assembly seen generally at 12 which includes a fan assembly 14, a low pressure compressor assembly 16 and a low pressure turbine assembly 18, and a high pressure spool assembly seen generally at 20 which includes a high pressure compressor assembly 22 and a high pressure turbine assembly 24. The annular core case 13 surrounds the low and high pressure spool assemblies 12 and 20 in order to define a main fluid path (not numbered) therethrough. In the main fluid path there is provided a combustor to constitute a gas generator section 26. An annular bypass air duct 28 is defined radially between the annular outer case 10 and the annular core case 13 for directing a main bypass air flow (not numbered) driven by the fan assembly 14, to pass therethrough and to be discharged to the atmosphere to create a bypass air thrust to the aircraft engine.

Figure 2:
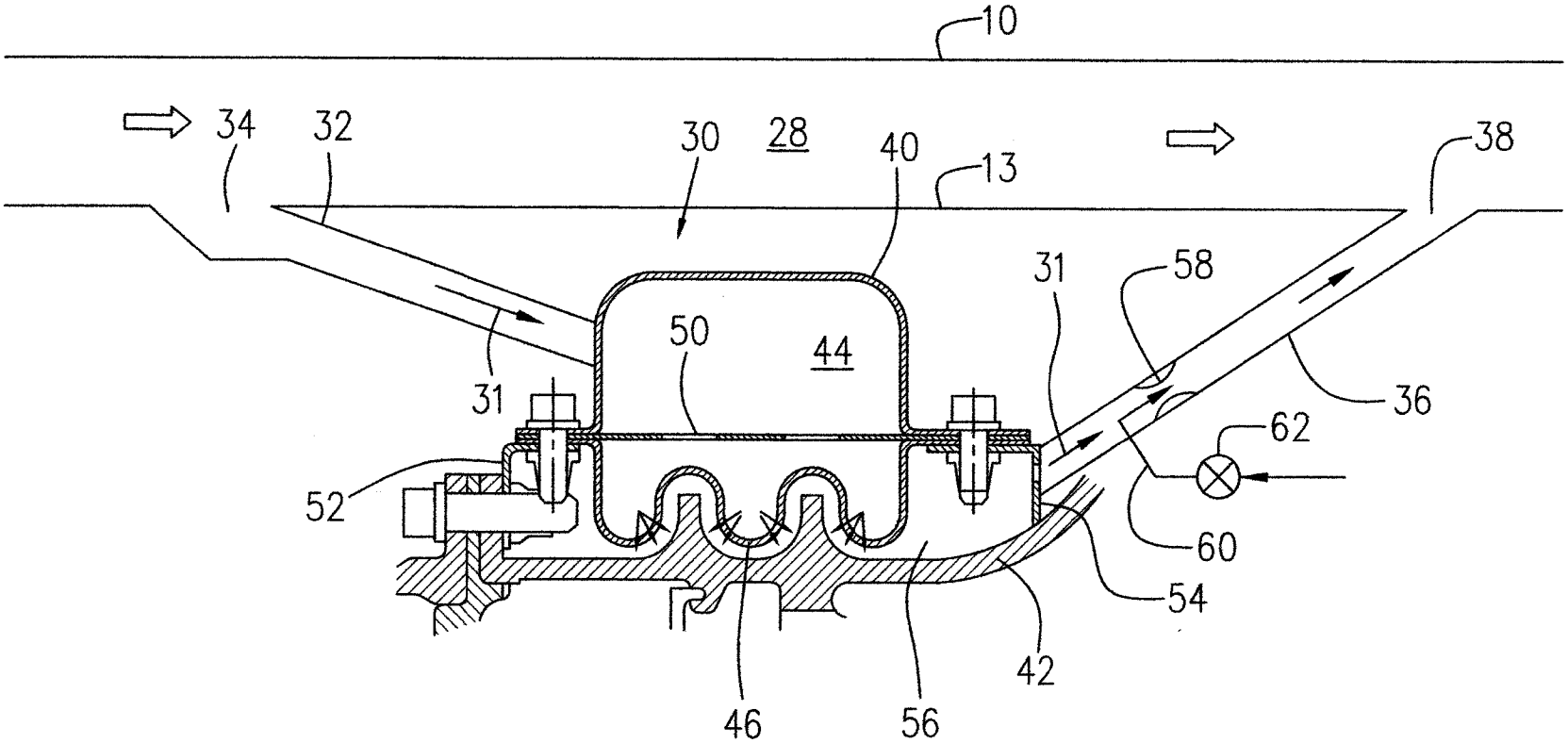
FIG. 2 is a schematic cross-sectional view of the turbofan gas turbine engine of FIG. 1, showing the ATCC system according to one embodiment.
Figure 5:
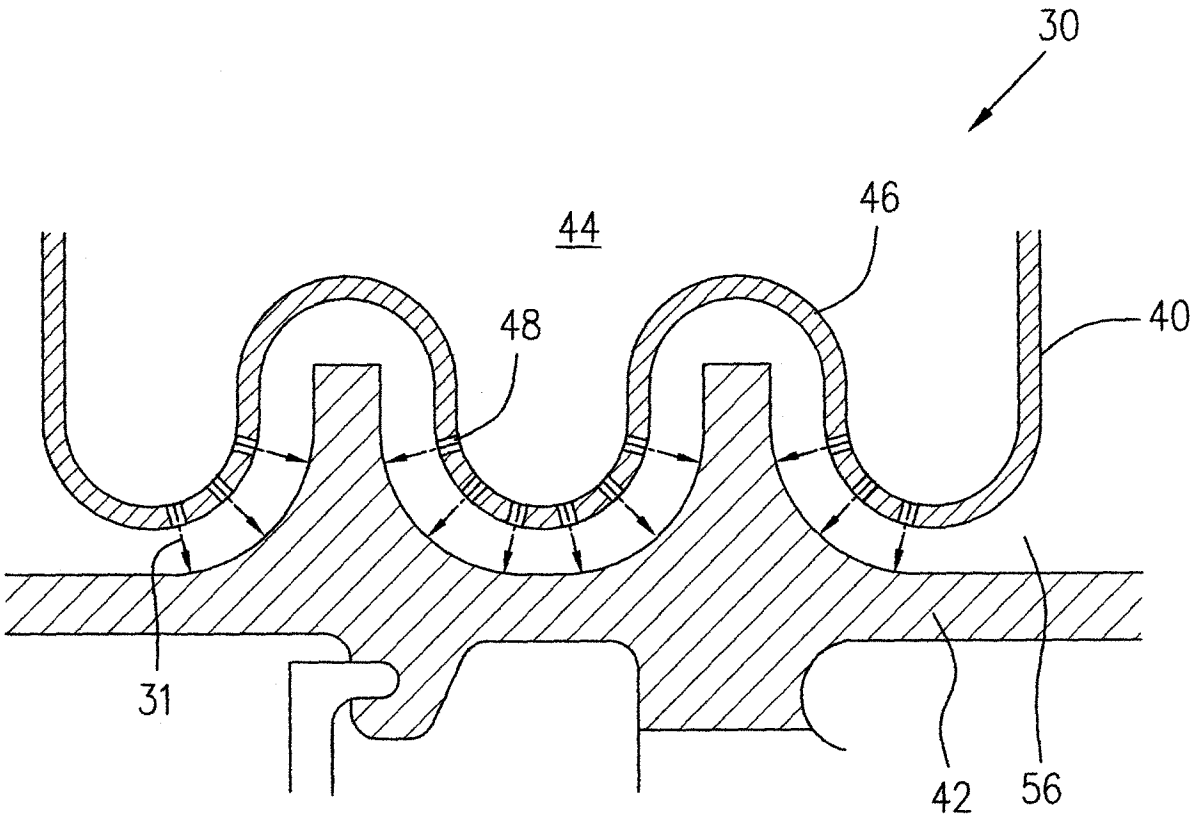
FIG. 5 is a partial cross-sectional view of the ATCC system of FIG. 2 in an enlarged scale, showing the occurrence of impingement cooling on a pressure differential.

Referring to FIGS. 1-2 and 5, the turbofan gas turbine aircraft engine according to one embodiment includes an active tip clearance control (ATCC) system 30 located within the core case 13. The ATCC system 30 has an inlet passage 32 connected to the bypass air duct 28 at a location for example, immediately downstream of the fan assembly 14. An inlet 34 of the inlet passage 32 may be defined in the core case 13 or may be defined as a scoop (not shown) incorporated with a radial hollow strut (not numbered) in the annular bypass air duct 28, for introducing a portion (indicated by arrows 31) of the bypass air flow into the ATCC system 30. A vent passage 36 is provided to the ATCC system 30 and is in fluid communication with the atmosphere, for example via the bypass air duct 28, as shown in FIG. 2. The vent passage 36 according to this embodiment, has an outlet 38 defined in the bypass duct 28 at a location downstream of the location of the inlet 34. The ATCC system 30 is sealed to prevent leakage of the portion 31 of the bypass air flow passing through the ATCC system 30. Therefore, the portion 31 of the bypass air flow passes through the ATCC system 30 is discharged only through the vent passage 36 to the bypass duct 28 and then to outside of the engine.

The ATCC system 30 may include an annular manifold 40, which is positioned around the turbine assembly (either the high pressure turbine assembly 24 or low pressure turbine assembly 18), for example, around an annular turbine case 42 such as a turbine support case or a turbine shroud. The manifold 40 defines a annular plenum 44 therein and is connected with the inlet passage 32. Therefore, the portion 31 of the bypass air flow is introduced from the annular bypass air duct 28 through the inlet 34 and inlet passage 32 and then into the annular plenum 44. The manifold 40 may further include a shield 46 which is configured to contour an outer surface of the turbine case 42 and includes a plurality of holes 48 defined in the shield 46 (see FIG. 5), to allow the portion 31 of the bypass air flow to be discharged from the holes 48 and to impinge on the outer surface of the annular turbine case 42 in order to cool the annular turbine case 42 and other turbine components (not shown) which are directly connected to the turbine case 42, thereby reducing blade tip clearances.

It is optional to provide a divider 50 with a plurality of openings (not numbered) within the annular manifold 40 to circumferentially divide the annular plenum 44 in order to improve pressure distribution of the portion 31 of the bypass air flow within the manifold 40.

The ATCC system 30 may further include mounting devices for mounting the manifold 40 on the turbine case 42. For example, a plurality of mounting brackets which mount the manifold 40 on the annular turbine case 42 are connected circumferentially one to another to form respective front and rear annular sealing walls 52, 54 extending radially between the manifold 40 and the turbine case 42 in order to thereby define a sealed annular cavity 56 between the manifold 40 and the annular turbine case 42. The vent passage 36 of the ATCC system 30 is connected, for example to the rear annular sealing wall 54 and is in fluid communication with the sealed annular cavity 56.

According to this embodiment an ejector 58 profiled for example as a venturi configuration is mounted on the vent passage 36. The ejector 58 is a conventional device and usually includes a secondary flow inlet (not numbered) to allow the portion 31 of the bypass air flow to be conducted through the venturi configuration in the vent passage 36 and a motive flow inlet (not numbered) which allows a high pressure air flow 60 to be injected into the venturi configuration to increase the energy level of the portion 31 of the bypass air flow. The vent passage 36 is in fluid communication with the atmosphere and has very low flow resistance. Therefore, the increased energy creates an increased momentum of the cooling air flow which flows away from the annular cavity 56. Therefore, the ejector 58 when driven by the high pressure air flow 60, creates a suction effect within the cavity 56 resulting in an increased pressure differential between the annular plenum 44 in the ATCC manifold 40 and the cavity 56 defined by the sealing walls 52, 54 of the brackets. This increased pressure differential ensures the effectiveness of the impingement cooling operation of the portion 31 of the bypass airflow discharged from the manifold 40.

According to this embodiment, a simple valve such as a solenoid valve 62 may be provided for controlling the high pressure air flow 60 being selectively injected into the vent passage 36 to actuate the ejector 58. It will be understood that any suitable controllable valve may be used. The high pressure air flow 60 may be from compressor air of the engine, such as P2.5, P2.8 or P3 air. The solenoid valve 62 may be controlled by an electric signal sent from, for example the electric engine control console (ECC) (not shown), according to engine operation requirements.

Therefore, in this embodiment the engine may control the ATCC system by amplifying a control signal such as an electric signal from the ECC of the engine to control the ATCC system 30 in two steps. First, the solenoid valve 62 is selectively actuated using the electric signal as the control signal to control an on/off condition of the high pressure air flow 60. Second, the ejector 58 is selectively actuated using the on/off controlled high pressure air flow 60 to drive the portion 31 of bypass air flow through the ATCC system 30, thereby selectively increasing the energy level of the portion 31 of the bypass air flow as the cooling air flow passing through the ATCC system 30, resulting in increased pressure differential between inside and outside of the ATCC manifold 40. It should be noted that in each time unit, the volume of the high pressure air flow controlled by the solenoid valve is much smaller than the volume of the portion 31 of the bypass air flow passing through the ATCC system 30. Therefore, the relatively simple, low cost and low weight solenoid valve replaces a conventional regulating valve which is conventionally used in ATCC systems for directly regulating the large amount of cooling air flow passing through the ATCC systems.

The temperature of the high pressure air flow 60 such as P2.5, P2.8 or P3 air is relatively higher than the temperature of the cooling air flow, such as the portion 31 of the bypass air flow passing through the ATCC system 30. Injection of the high pressure air flow 60 into the portion 31 of the bypass air flow passing through the ATCC system 30, may result in increased temperatures of the portion 31 of the bypass air flow mixed with the high pressure air flow 60, which however does not affect the cooling efficiency of the turbine case 42 because such fluid mixing occurs in the vent passage 36, downstream of the ATCC manifold 40 where the impingement cooling occurs.

Figure 3:
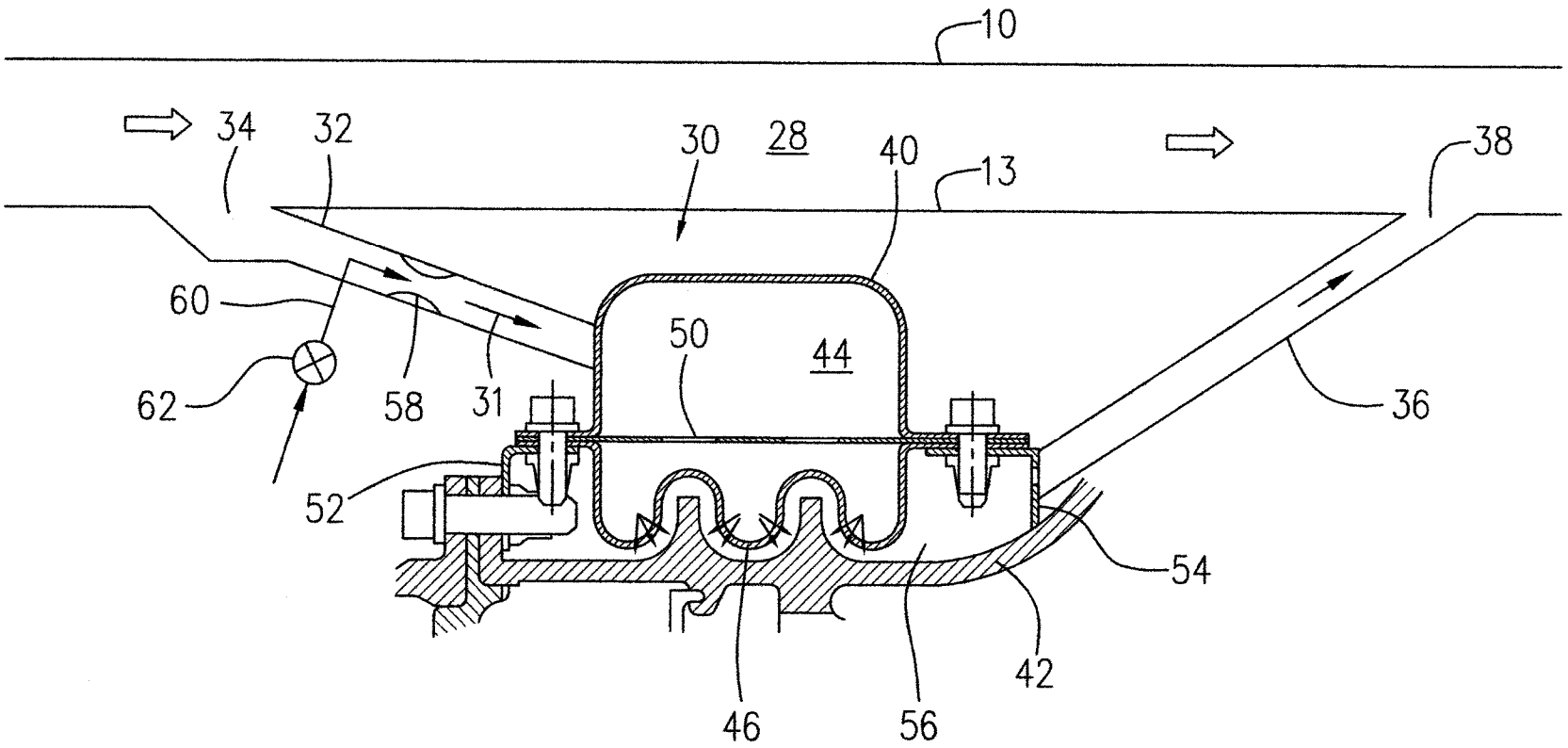
FIG. 3 a schematic cross-sectional view of the turbofan gas turbine engine of FIG. 1, showing the ATCC system according to another embodiment.

FIG. 3 illustrates another embodiment in which the ATCC system 30 is similar to the described embodiment with reference to FIG. 2. Similar components and features indicated by similar numeral references will not be redundantly described herein. The difference between the embodiment shown in FIG. 3 and the embodiment shown in FIG. 2 lies in that the ejector 58 is mounted on the inlet passage 32 rather than the vent passage 36 of the ATCC system 30 and the solenoid valve 62 is relocated accordingly. The injection of high pressure air flow 60 into the portion 31 of the bypass air flow passing through the venturi configuration of the ejector 58 mounted on the inlet passage 32, also increases the energy level of the portion 31 of the bypass air flow, thereby boosting the low pressure stream of the cooling air flow (the portion 31 of the bypass air flow) to a relatively high pressure level, resulting in an increased pressure differential between the annular plenum 44 in the ATCC manifold 40 and the annular cavity 56 defined with the sealing walls 52 and 54. The increased pressure differential is controllably created by selectively actuating the solenoid valve to provide an on/off condition of the high pressure air flow 60 to the ejector 58. The amount of high pressure air flow 60 with relatively high temperatures injected into the portion 31 of the bypass air flow in the inlet passage is relatively small and therefore, the temperature of the portion 31 of the bypass air flow in the inlet passage will not be significantly increased to affect the cooling operation of the turbine case 42.

Figure 4:
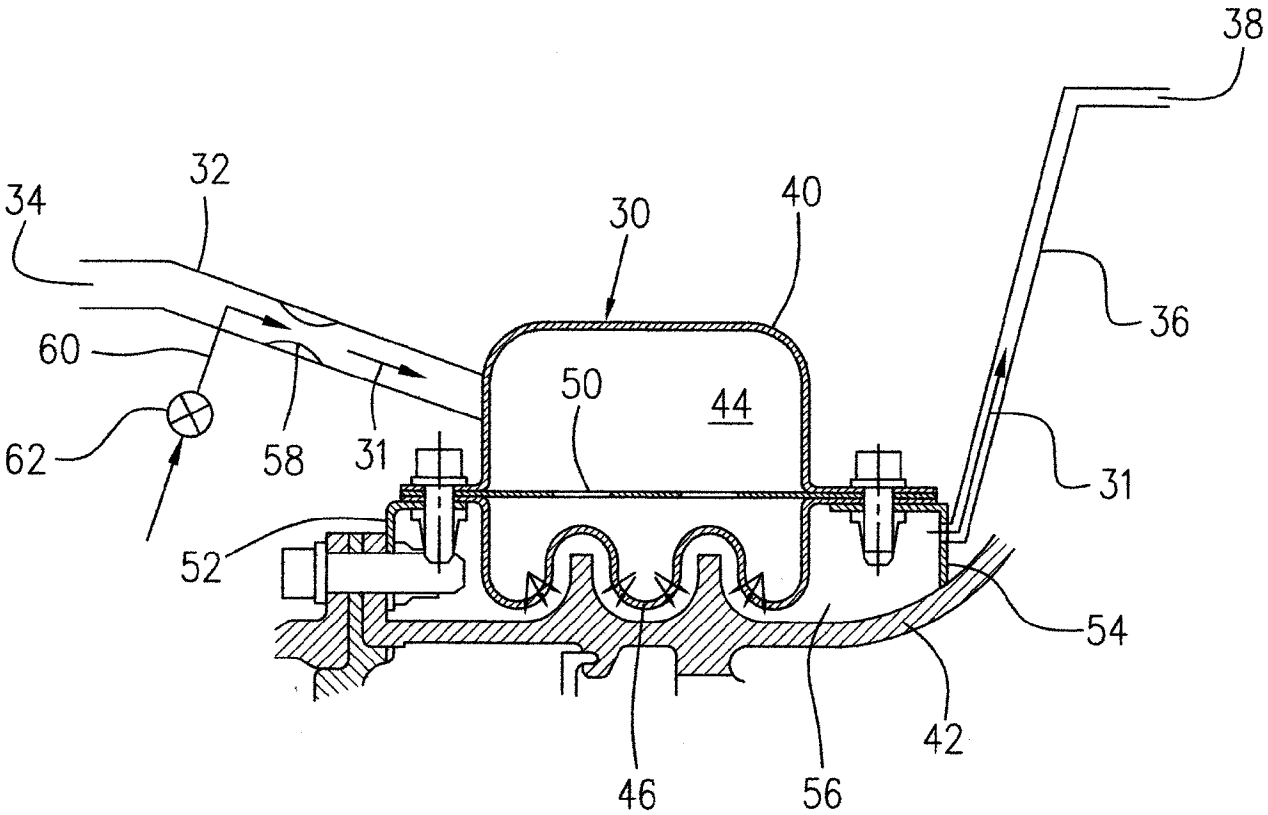
FIG. 4 is schematic cross-sectional view of a ATCC system according to a further embodiment for use in the turbofan gas turbine engine of FIG. 1 or for use in other types of aircraft gas turbine engines.

FIG. 4 illustrates a further embodiment in which the ATCC system 30 is similar to those described with reference to respective FIGS. 2 and 3, and similar components and features indicated by similar numeral references will not be redundantly described herein. The difference between the embodiment shown in FIG. 4 and the embodiments shown in respective FIGS. 2 and 3, lies in that inlet 34 of the inlet passage 32 and outlet 38 of the vent passage 36 of the ATCC system 30 of FIG. 4 is in direct fluid communication with the atmosphere, rather than defined in the bypass air duct 28 of the engine as shown in FIG. 2 or 3. Therefore, the embodiment illustrated in FIG. 4 may be applicable in a turbofan gas turbine engine of FIG. 1, and may also be applicable in aircraft gas turbine engines other than a turbofan type. The ejector 58 in this embodiment of FIG. 4 is shown on the inlet passage 32 with the solenoid valve 52 positioned accordingly. Nevertheless, it should be understood that the ejector 58 may be alternatively mounted to the vent passage 36 with the solenoid valve 62 positioned accordingly, as illustrated in FIG. 2.

The above description is meant to be exemplary only, and one skilled in the art will recognize that changes may be made to the embodiments described without departure from the scope of the described subject matter. For example, the described embodiments may be modified by various combinations of the described embodiment, such as a portion of the bypass air flow being introduced to the ATCC system and discharged directly to the atmosphere, or ambient air being introduced to the ATCC system and dumped to a downstream location of the bypass air duct of the engine. Furthermore, the described components of the ATCC system such as the ATCC manifold may be modified. It will also be understood that the system may be employed in a heating, rather than cooling, configuration when connected to a suitable hot air source. The ATCC system may also be applicable for active tip clearance control of other rotor assemblies, such as compressor assemblies of gas turbine engines. Still other modifications which fall within the scope of the described subject matter will be apparent to those skilled in the art, in light of a review of this disclosure, and such modifications are intended to fall within the appended claims.

The invention claimed is:

1. An active tip clearance control (ATCC) system of a gas turbine engine comprising an ATCC manifold disposed adjacent a rotor case, the manifold configured for directing air over the rotor case, an inlet passage fluidly connecting the ATCC manifold with an air source selected from one of ambient air and a fan driven bypass air flow directed through a bypass duct of the engine, a vent passage in fluid communication with the manifold and the atmosphere for venting air received from the ATCC manifold to the atmosphere, a controllable valve receiving and controlling a compressor air flow, and an ejector for ejecting the controlled compressor air flow to selectively drive only said selected one of ambient air and fan driven bypass air flow through the ATCC manifold.

2. The active tip clearance control (ATCC) system as defined in claim 1 wherein the ejector is mounted on the inlet passage and positioned upstream of the manifold to drive the air through the inlet passage towards the ATCC manifold.

3. The active tip clearance control (ATCC) system as defined in claim 1 wherein the ejector is mounted on the vent passage and positioned downstream of the manifold to drive the air through the vent passage and away from the ATCC manifold.

4. The active tip clearance control (ATCC) system as defined in claim 1 wherein the vent passage is in fluid communication with the atmosphere via the bypass duct.

5. An aircraft turbofan gas turbine engine comprising:

an annular outer case surrounding a fan assembly;

an annular core case positioned within the outer case and accommodating a compressor assembly, a combustion gas generator assembly and a turbine assembly, the annular outer and core cases defining an annular bypass duct therebetween for directing a bypass air flow driven by the fan assembly to pass therethrough; and an active tip clearance control (ATCC) apparatus including an ATCC manifold mounted to a turbine case for discharging cooling air over the turbine case to cool the same, an inlet passage connecting the ATCC manifold with the bypass duct at a first location of the bypass duct, a vent passage disposed downstream of the ATCC manifold and being in fluid communication with the bypass duct at a second location of the bypass duct downstream of the first location, the ATCC apparatus further including a solenoid valve controlling a compressor air flow and an ejector for ejecting the controlled compressor air to selectively drive only the bypass air flow as the cooling air through the ATCC manifold.

6. The aircraft turbofan gas turbine engine as defined in claim 5 wherein the ejector is mounted on the inlet passage to drive the cooling air through the inlet passage towards the ATCC manifold.

7. The aircraft turbofan gas turbine engine as defined in claim 5 wherein the ejector is mounted on the vent passage to drive the cooling air through the vent passage and away from the ATCC manifold.

8. The aircraft turbofan gas turbine engine as defined in claim 5 wherein the ejector is formed with a hole defined in a side wall of one of the inlet and vent passages for receiving the controlled compressor air flow to be injected into said one of the inlet and vent passages.

9. The aircraft turbofan gas turbine engine as defined in claim 5 wherein a volume of the compressor air flow is smaller than a volume of the cooling air flow in each time unit.

10. A method for controlling an active tip clearance control (ATCC) system to cool a turbine casing of a gas turbine engine, comprising amplifying a control signal for actuating the ATCC system in steps of:

a) electively actuating a solenoid valve using an electric signal as the control signal to control an on/off condition of a compressor air flow; and b) using the on/off-controlled compressor air flow to selectively actuate an ejector which drives a cooling air flow introduced only from a bypass duct of the engine through the ATCC system and vented to the bypass duct, thereby selectively increasing an energy level of the cooling air flow passing through the ATCC system, resulting in an increased pressure differential over the ATCC system.

11. The method as defined in claim 10 wherein a volume of the compressor air flow is smaller than a volume of the cooling air flow in each time unit.

12. The method as defined in claim 10 wherein in step (b) the compressor air flow is injected by the ejector into the cooling air flow in the ATCC system upstream of the turbine casing which the ATCC system selectively discharges the cooling air flow to cool, thereby boosting the cooling air flow upstream of the turbine case to a high pressure level.

13. The method as defined in claim 10 wherein in step (b) the compressor air flow is injected by the ejector into the cooling air flow in the ATCC system, downstream of the turbine casing which the ATCC system selectively discharges the cooling air flow to cool, thereby increasing a momentum of the cooling air flow downstream of the turbine case in order to create a suction effect on the cooling air flow discharged from the ATCC system.

* * * * *